US006876284B2

(12) United States Patent
Wright et al.

(10) Patent No.: US 6,876,284 B2
(45) Date of Patent: Apr. 5, 2005

(54) HIGH INTENSITY RADIAL FIELD MAGNETIC ARRAY AND ACTUATOR

(75) Inventors: Andrew M. Wright, Cambridge, MA (US); David Cope, Medfield, MA (US)

(73) Assignee: Engineering Matters, Inc., Newton Upper Falls, MA (US)

( * ) Notice: Subject to any disclaimer, the term of this patent is extended or adjusted under 35 U.S.C. 154(b) by 0 days.

(21) Appl. No.: 10/899,794

(22) Filed: Jul. 27, 2004

(65) Prior Publication Data

US 2005/0007228 A1 Jan. 13, 2005

Related U.S. Application Data

(63) Continuation-in-part of application No. 10/255,984, filed on Sep. 26, 2002.

(51) Int. Cl.[7] ..... H01F 7/00; H01F 7/08
(52) U.S. Cl. ..... 335/229; 335/234; 335/306
(58) Field of Search ..... 335/179, 229–234, 335/255–259, 264–269, 274, 306; 310/12–15

(56) References Cited

U.S. PATENT DOCUMENTS

| | | | | |
|---|---|---|---|---|
| 4,439,700 A | * | 3/1984 | Menzel et al. | 310/13 |
| 5,097,161 A | | 3/1992 | Nashiki et al. | 310/12 |
| 5,847,480 A | | 12/1998 | Post | 310/90.5 |
| 6,259,174 B1 | | 7/2001 | Ono | 310/13 |
| 6,304,320 B1 | | 10/2001 | Tanaka et al. | 355/73 |
| 6,316,849 B1 | | 11/2001 | Konkola et al. | 310/12 |
| 6,355,994 B1 | | 3/2002 | Andeen et al. | 310/15 |
| 6,408,045 B1 | | 6/2002 | Matsui et al. | 378/34 |
| 6,512,571 B2 | | 1/2003 | Hara | 355/53 |
| 6,590,355 B1 | | 7/2003 | Kikuchi et al. | 318/135 |
| 2001/0017490 A1 | | 8/2001 | Suzuki et al. | 310/12 |
| 2002/0190582 A1 | | 12/2002 | Denne | 310/14 |
| 2003/0030779 A1 | | 2/2003 | Hara | 355/53 |
| 2003/0052548 A1 | | 3/2003 | Hol et al. | 310/12 |

OTHER PUBLICATIONS

Image from PPT presentation, Corcoran Engineering, Apr. 2001, re: (Linear) Halbach Array Magnet Configuration.

* cited by examiner

*Primary Examiner*—Ramon M. Barrera
(74) *Attorney, Agent, or Firm*—Hayes Soloway PC

(57) ABSTRACT

At least one set of two nested magnetic arrays is provided, each nested magnetic array having an outer magnet, a middle magnet, and an inner magnet. The outer magnet has a magnetization pointing in an at least partially axial direction. The middle magnet has a magnetization substantially perpendicular to the magnetization of the outer magnet. The inner magnet has a magnetization directed substantially anti-parallel to the magnetization of the outer magnet. The apparatus also includes at least one electrically conductive coil positioned at least partially between the two nested magnetic arrays. At least one substantially magnetically permeable object is positioned at least partially between the two nested magnetic arrays. A rod is integral with the substantially magnetically permeable object.

22 Claims, 16 Drawing Sheets

HIGH INTENSITY RADIAL FIELD MAGNETIC ARRAY AND ACTUATOR

The present application is a continuation in part and claims benefit of pending U.S. patent application Ser. No. 10/255,984, filed on Sep. 26, 2002, the disclosure of which is incorporated herein by reference.

FIELD OF THE INVENTION

The present invention is related to the field of magnetism, and in particular, is related to direct drive actuators employing a radial magnetic field and conducting coil acting on an element of a valve.

BACKGROUND OF THE INVENTION

Actuators are traditionally a mechanical art. Most actuators contain valves, springs, and pivoting elements that move the valves. One of the problems with mechanical actuators is that parts of the mechanical actuators have a tendency to wear down. When the springs become less elastic and the pivoting joints become worm, the valves cease to operate in an efficient manner. An actuator with fewer moving parts would tend to outlast the traditional mechanical actuators.

Recently, a need has developed for actuators that are extremely small. For instance, through rapid advancement in the miniaturization of essential elements such as inertial measurement units, sensors, and power supplies, Micro Air Vehicles (MAVs) have been developed. These MAVs are being designed to be as small as 15 centimeters. Mechanical actuators at such a small size are extremely unwieldy and unreliable.

Thus, a heretofore unaddressed need exists in the industry to address the aforementioned deficiencies and inadequacies.

SUMMARY OF THE INVENTION

Embodiments of the present invention provide a system and method for providing an actuator.

Briefly described, in architecture, one embodiment of the system, among others, can be implemented as follows. The actuator system provides at least one set of two nested magnetic arrays, each nested magnetic array having an outer magnet, a middle magnet, and an inner magnet. The outer magnet has a magnetization pointing in an at least partially axial direction. The middle magnet has a magnetization substantially perpendicular to the magnetization of the outer magnet. The inner magnet has a magnetization directed substantially anti-parallel to the magnetization of the outer magnet. The apparatus also includes at least one electrically conductive coil positioned at least partially between the two nested magnetic arrays. At least one substantially magnetically permeable object is positioned at least partially between the two nested magnetic arrays. A rod is physically integral with the substantially magnetically permeable object and extends therefrom.

The present invention can also be viewed as providing methods for moving an actuator. In this regard, one embodiment of such a method, among others, can be broadly summarized by the following steps: proximately assembling at least one set of two nested magnetic arrays, the magnetic arrays comprising: an outer magnet having a magnetization pointing in an at least partially axial direction; a middle magnet having a magnetization substantially perpendicular to the magnetization of the outer magnet; and an inner magnet having a magnetization directed substantially anti-parallel to the magnetization of the outer magnet; positioning at least one substantially magnetically permeable object at least partially between the two nested magnetic arrays; positioning at least one electrically conductive coil at least partially between the two nested magnetic arrays; and initiating a current in a first direction within the conductive coil, which magnetically forces the substantially magnetically permeable object toward a first magnetic array of the magnetic arrays.

Other systems, methods, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
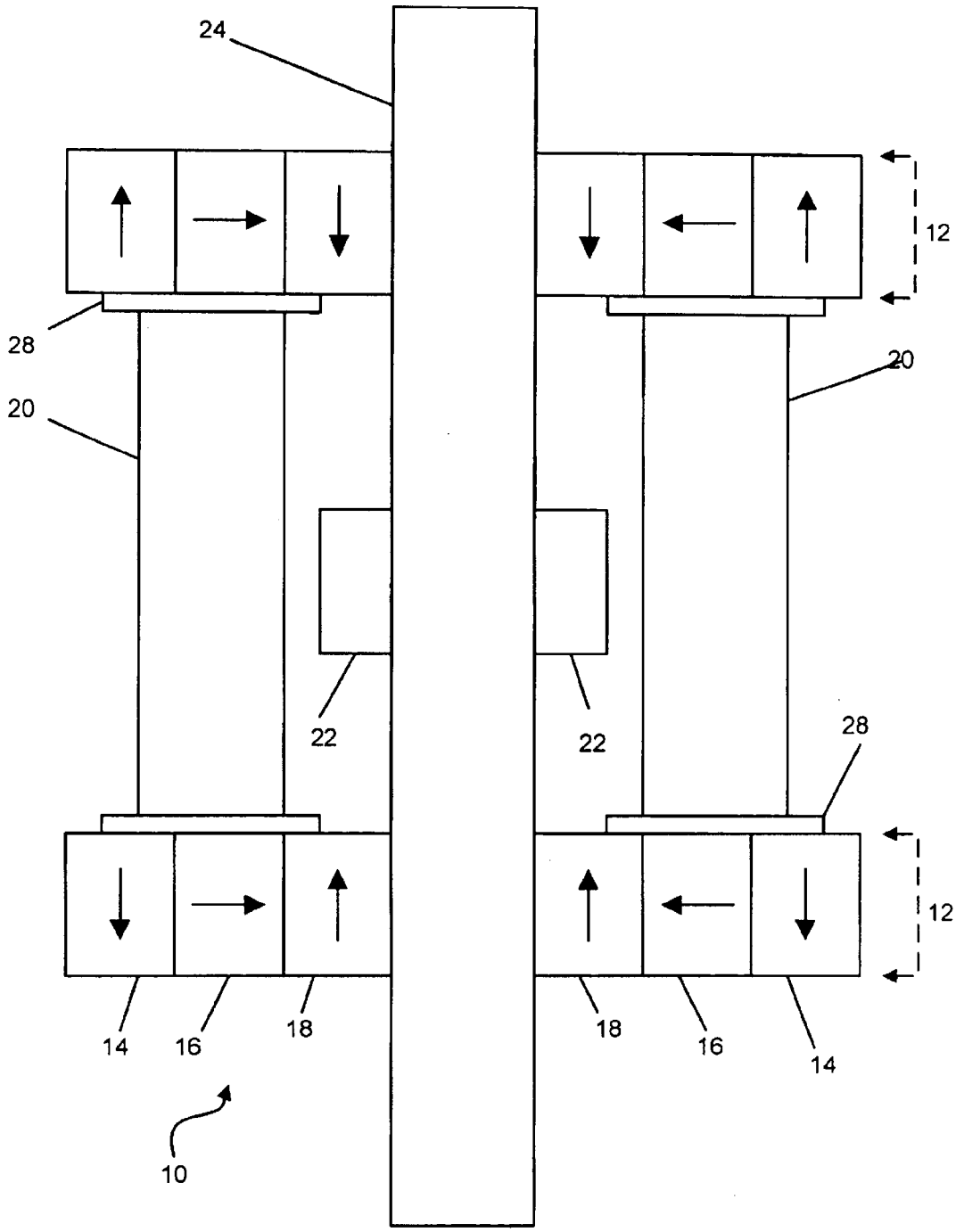
FIG. 1 is a cross-sectional view of a first exemplary embodiment of the magnetic array and actuator of the present invention.
Figure 2:
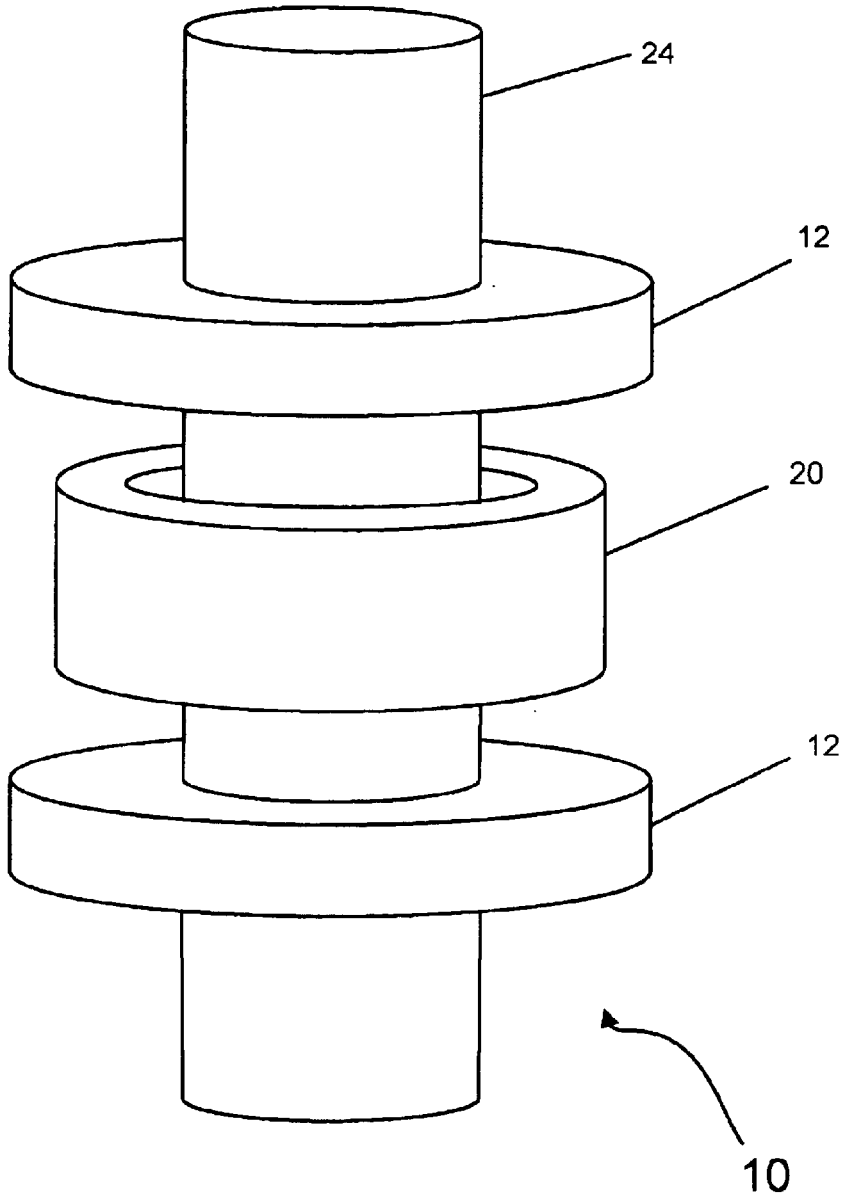
FIG. 2 is a perspective view of the first exemplary embodiment of the magnetic array and actuator of the present invention

FIG. 1 is a cross-sectional view and FIG. 2 is a perspective view of a first exemplary embodiment of the magnetic array and actuator 10. At least one set of two nested magnetic arrays 12 is provided, each nested magnetic array 12 having an outer magnet 14, a middle magnet 16, and an inner magnet 18. The magnetization of the three magnets 14, 16, 18 is illustrated by arrows shown within the magnets 14, 16, 18. The outer magnet 14 has a magnetization pointing in an at least partially axial direction. The middle magnet 16 has a magnetization substantially perpendicular to the magnetization of the outer magnet 14. The inner magnet 18 has a magnetization directed substantially anti-parallel to the magnetization of the outer magnet 14. Comparing the magnetization of the magnets 14, 16, 18 in the two nested magnetic arrays 12, the magnetizations of the two outer magnets 14 are anti-parallel, the magnetizations of the two middle magnets 16 are parallel, and the magnetizations of the two inner magnets 18 are anti-parallel. The magnetic array and actuator 10 also includes at least one electrically conductive coil 20 positioned at least partially between the two nested magnetic arrays 12. At least one substantially magnetically permeable object 22 is positioned at least partially between the two nested magnetic arrays 12. A rod 24 is integral with the substantially magnetically permeable object 22. The rod 24 may be permanently or releasably connected to the substantially magnetically permeable object 22 or the rod 24 and the substantially magnetically permeable object 22 may be a one-piece unit. In this embodiment, the rod 24 extends axially within each of the two nested magnetic arrays 12 and the electrically conductive coil 20. Specifically, the magnetic arrays 12 provide an opening within which the rod 24 is located. Therefore, the rod 24 is capable of vertically shifting through the magnetic arrays 12.

As can be seen from FIG. 2, the nested magnet arrays 12 of the present invention are designed to be single-piece, cylindrical magnets 14, 16, 18. However, other geometric three-dimensional shapes, including those with square, hexagonal, or octagonal cross-sections can be used. Similarly, while single-piece magnets 14, 16, 18 are envisioned, the nested magnet arrays 12 can be comprised of a plurality of magnet pieces that together form a cylindrical or other acceptable three-dimensional shape. Those having ordinary skill in the art will recognize a vast number of permutations exist for the acceptable shape of the nested magnet arrays 12.

Figure 3:
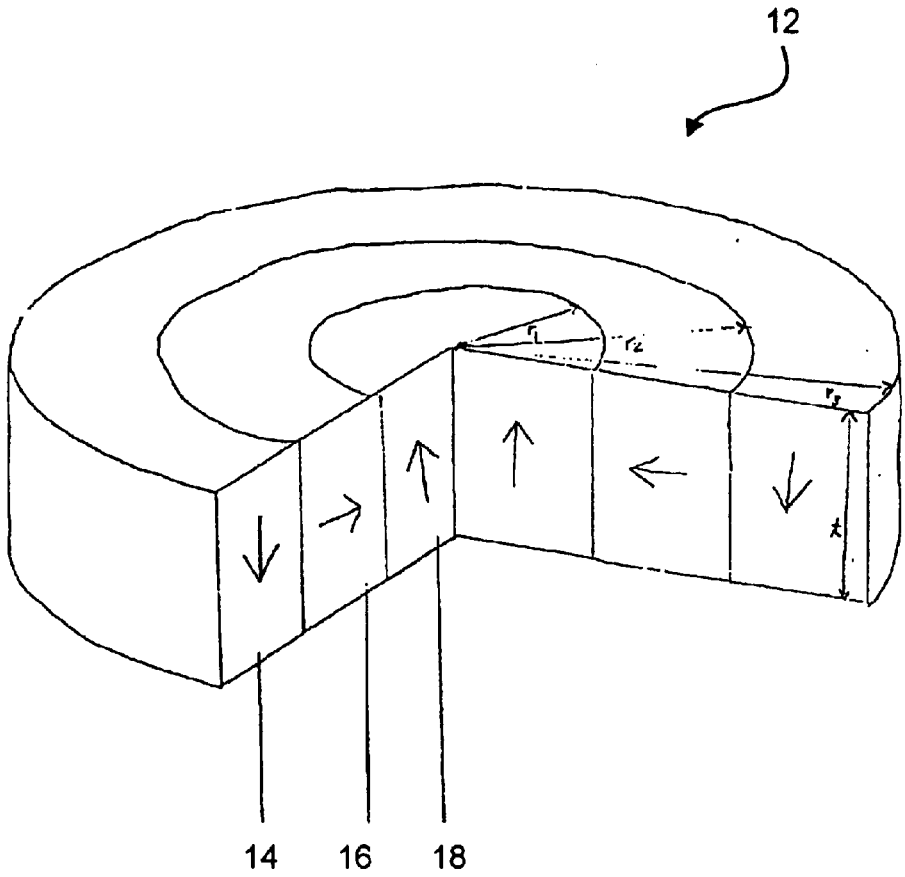
FIG. 3 is a partial cutaway schematic view of an exemplary high intensity radial field (HIRF) permanent magnet array.

FIG. 3 is a schematic view of one the nested magnetic arrays 12 consistent with the present invention. It should be noted that the magnetic array 12 of FIG. 3 is shown as a solid cylindrical member, while the magnetic arrays 12 shown in FIG. 1 require an annular inner magnet 18. This illustration is merely for exemplary purposes. In some embodiments, such as that in FIG. 1, it is understood that the inner magnet 18 is annular for allowing the rod 24 to reside therein and vertically shift within the magnetic array 12.

The nested magnetic array 12 comprises two nested annular magnets 14, 16 and an inner cylindrical magnet 18, which could also be annular, which are magnetized in the orientations shown in FIG. 3 or in their opposite orientations, respectively. The outer magnet 14 has a magnetization pointing axially out of the bottom of the array; the magnetization of the middle magnet 16 is perpendicular to the magnetization of the outer magnet 14 and points in the inward radial direction; and the magnetization of the inner magnet 18 points anti-parallel to the outer magnet 14, i.e., out of the top of the array. Inner and outer magnets 14, 18 are anti-parallel to each other and may be magnetized in the opposite directions, and the middle magnet 16 may be magnetized in either radial direction, in both cases, depending on the side axially where the magnetic field is to be intensified.

Figure 4:
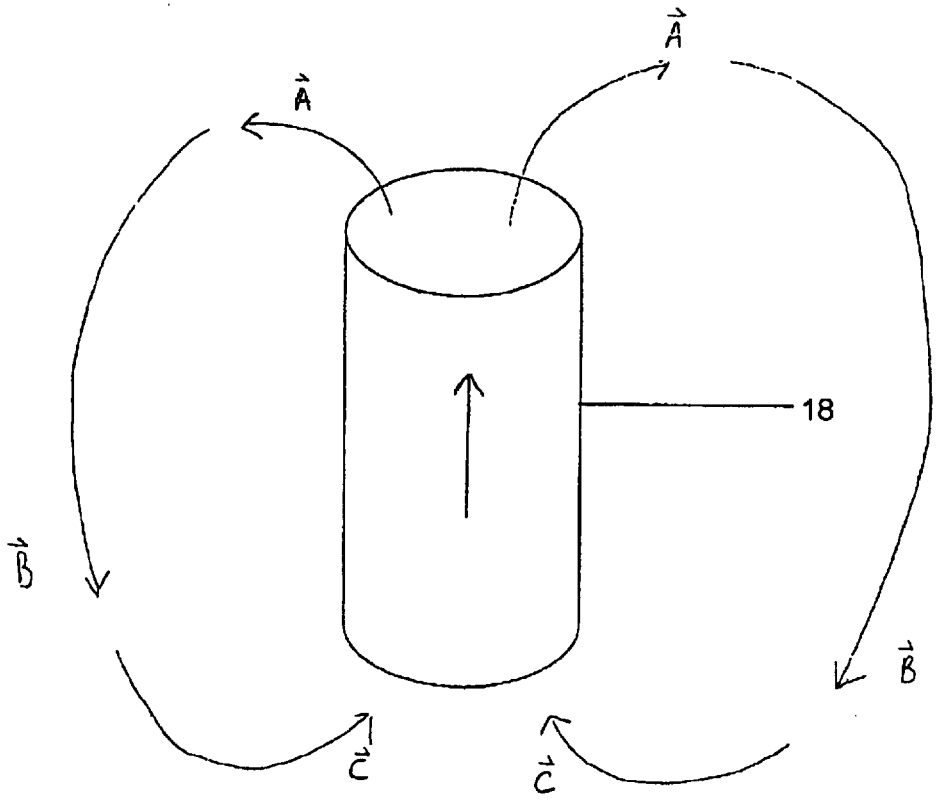
FIG. 4 is a perspective view of the inner magnet, consistent with the first exemplary embodiment of the present invention, illustrating magnetic field lines created by magnetization of the inner magnet.
Figure 5:
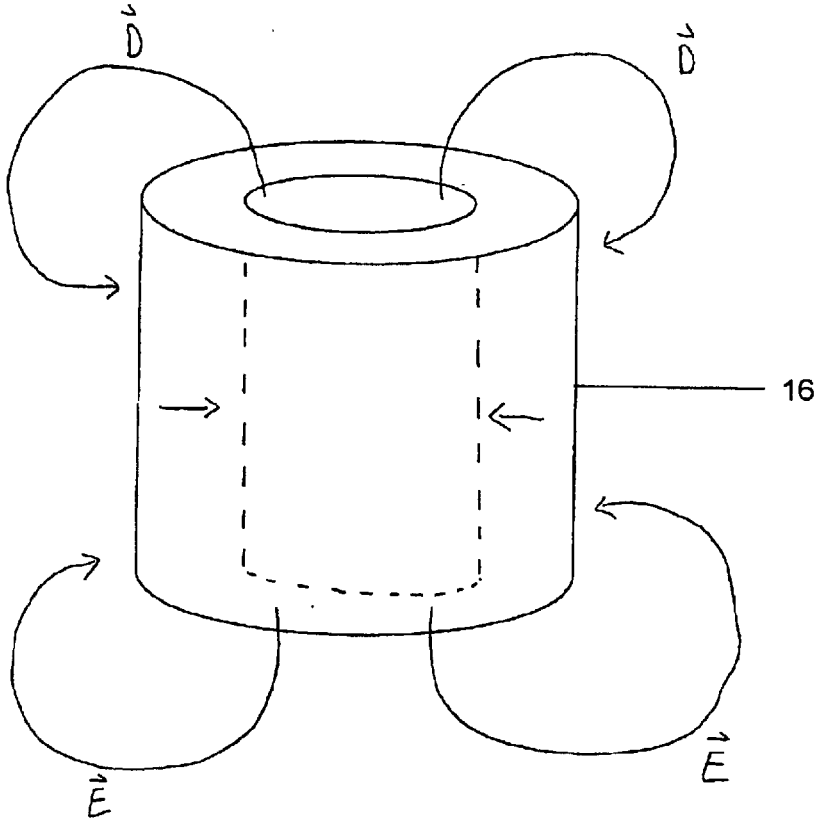
FIG. 5 is a perspective view of the middle magnet, consistent with the first exemplary embodiment of the present invention, illustrating magnetic field lines created by magnetization of the middle magnet.
Figure 6:
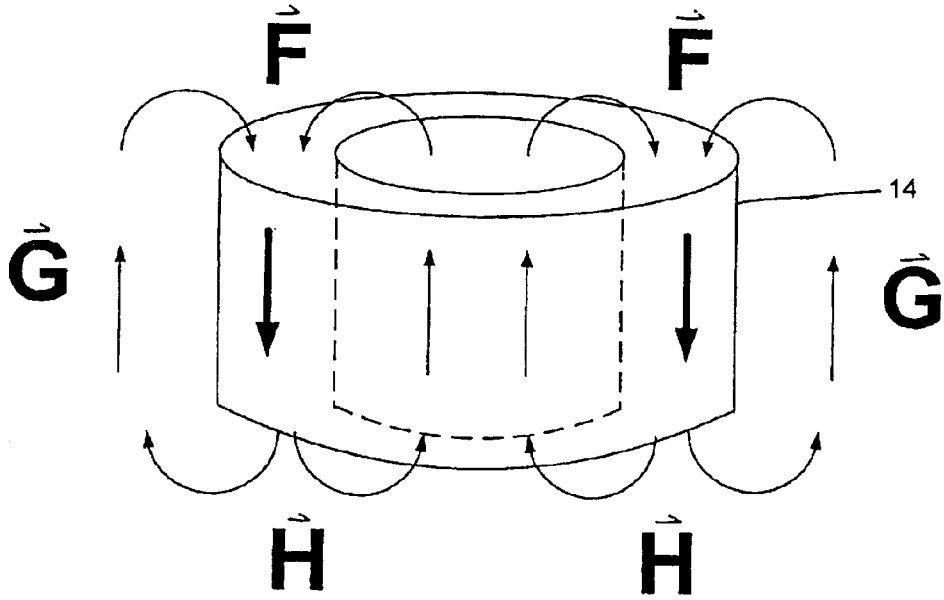
FIG. 6 is a perspective view of the outer magnet, consistent with the first exemplary embodiment of the present invention, illustrating magnetic field lines created by magnetization of the outer magnet.

The magnetic fields created by each of the three nested magnets 14, 16, 18 in the nested magnetic array 12 are shown in FIGS. 4–6. FIG. 4 shows the direction of the magnetic field lines created by the inner magnet 18. The magnetic field for the inner magnet 18 points vertically upward inside the inner magnet 18 and curls around to the outside of the inner magnet 18 from the top to the bottom as represented by vectors A, B, and C.

FIG. 5 shows the magnetic field of the middle magnet 16. The magnetization points radially inward inside the middle magnet 16. Vectors D and E represent the direction of the magnetic field outside the middle magnet 16.

The magnetic field of the outer magnet 14 is illustrated in FIG. 6. The magnetization of the outer magnet 14 is vertically downward. The direction of the magnetic field is represented in FIG. 6 by vectors F, G and H.

Figure 7:
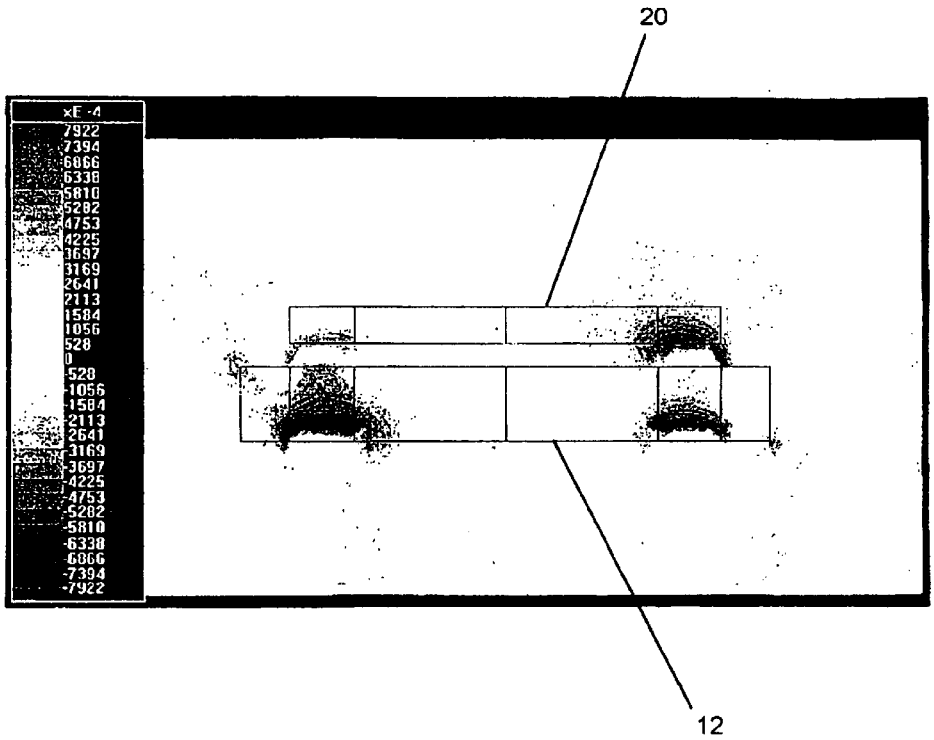
FIG. 7 is a plot illustrating the radial/horizontal magnetic field intensity from the permanent magnetic array of FIG. 1, in accordance with the first exemplary embodiment.
Figure 8:
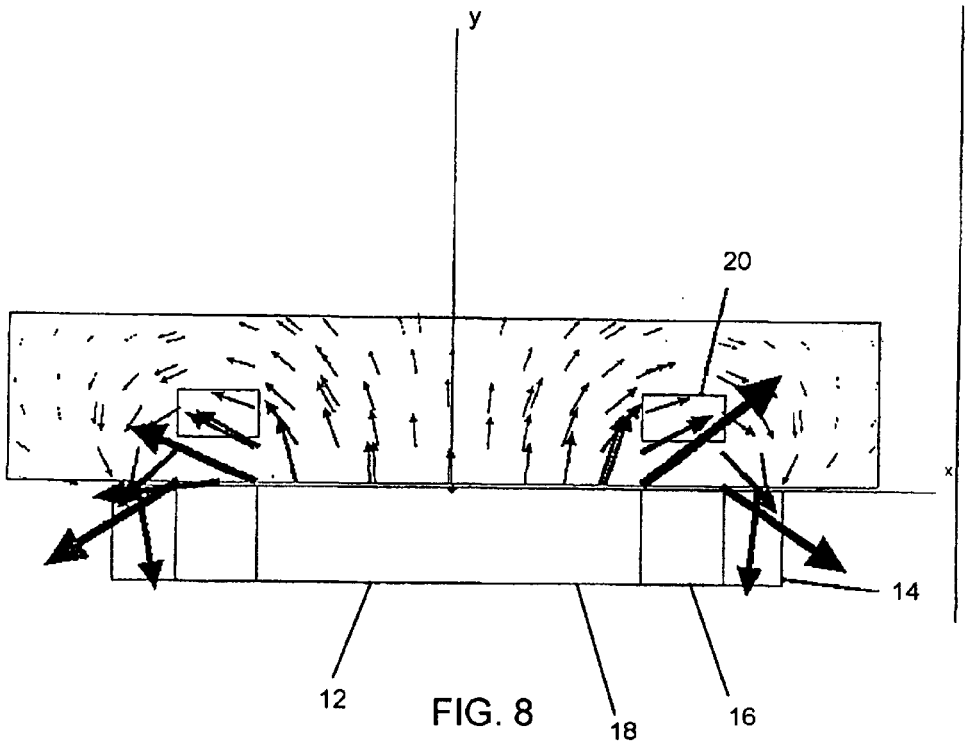
FIG. 8 is an arrow plot illustrating the radial magnetic field orientation above one magnetic array and intersecting a conductive coil, in accordance with the first exemplary embodiment.

Superposing the fields of the three magnets 14, 16, 18 will produce the magnetic field of the magnetic array 12 shown in FIGS. 7 and 8. Referring to FIGS. 36, vectors A, D and F represent the fields of the three magnets 14, 16, 18 above the magnetic array 12, respectively. These three vectors are all pointing in the same direction above middle magnet 16, and therefore, the magnetic fields add together to create a high intensity magnetic field pointing radially outward. Vectors B and G represent the magnetic field along the side of the magnetic array 12. These two vectors are pointing in opposite directions and thus partially cancel one another. Finally, vectors C, E, and H represent the field of each magnet 14, 16, 18 below the array. The field E of the middle magnet 16 points in the opposite direction from the fields C and H of the two other magnets 14, 18. Therefore, there is a partial cancellation of the magnetic field in this area. Consequently, a very weak magnetic field exists below the array 12.

The vectorial addition of fields increases the radial field above the magnetic array 12, while decreasing the radial field below the magnetic array 12. By reversing the magnetization of the middle magnet 16, the high magnetic field can be shifted from above to below the magnetic array 12. Alternatively, the magnetization vectors of both the inner and outer magnets 14, 18 could be reversed to control the location of the large radial magnetic field.

A specific advantage of this magnet configuration is the shifting of magnetic field from unused space away from the conductor to where a conducting coil 20 is situated. This results in an efficient usage of the total magnetic field from the nested magnets 14, 16, 18. FIG. 7 shows the intensity of the radial (horizontal) component of the magnetic field. It should be noted that the magnetic field is strong where a conducting coil 20 is above the magnetic array 12, while comparatively non-existent below the magnetic array 12.

Another important aspect of the magnet array 12 is that the field extends radially above the magnets 14, 16, 18. FIG. 8 illustrates an arrow plot of the magnetic field orientation above the magnetic array 12, in the conductive coil 20 region. It should be noted that the magnitude of magnetic fields is represented by differently sized arrows, where larger sized arrows represent larger magnitudes of magnetic fields. In this exemplary embodiment of one magnetic array 12 of the present invention, the magnetic field curls from the inner magnetic field through the conductive coil 20 into the outer magnet 14. If the first magnetic field curls outward from the inner magnet 18 to the outer magnet 14, then the second magnetic field should also point radially outward, i.e., the middle magnet 16 magnetization is radially inward and its magnetic field outside the middle magnet 16 is outward.

Those having ordinary skill in the art will recognize that, although the foregoing embodiment describes a High Intensity Radial Field ("HIRF") actuator with reference to a magnetic array 12 below the conductive coil 20, the magnetic array 12 could, alternatively, be located on either side of or above the conductive coil 20.

The magnets 14, 16, 18 described herein may comprise rare earth magnets (e.g., NdFeB or SmCo). Since magnetic field superposition is a consideration, ceramic and AlNiCo magnets may be less desirable for some applications, as they do not have substantially linear responses (e.g., as compared to NdFeB). However, since ceramic magnets are linear over a portion of their operating curve, they may have potential utility in certain non-critical embodiments of the invention (e.g. actuators for toys).

Exemplary dimensions of a magnetic array 12 (e.g., as shown in FIG. 3) used with the present invention may be as follows: the inner magnet 18 having a radius $r_1$=2 mm and a height of 1 mm; the middle magnet 16 having an inner radius=$r_1$, an outer radius $r_2$=$r_1$+0.83 mm, and a height of 1 mm; and the outer magnet 14 having an inner radius=$r_2$, an outer radius $r_3$=$r_2$+0.63 mm, and a height of 1 mm. Here, the conductive coil 20 dimensions may be: inner radius=$r_1$, outer radius=$r_1$+0.83 mm, and a height t=0.5 mm. It should be noted that the flux area of the three magnets 14, 16, 18 is desirably constant (although not necessary), and the flux areas may be described by the following equations:

$$A1=.pi.*r_1^2(\text{top}) \quad \text{(Eq.1)}$$

$$A2=2*.pi.*r_1*t(\text{side}) \quad \text{(Eq.2)}$$

$$A3=.pi.*(r_3^2-r_2^2)(\text{top}) \quad \text{(Eq.3)}$$

$$\text{where } A1=A2=A3. \quad \text{(Eq.4)}$$

Further, the (vertical) gap between opposing magnet arrays 12 is Z=1.6 mm and the ampere-turns of the conductive coil 20 are NI=100 ampere-turns.

It should be understood that the aforementioned geometry and dimensions are merely exemplary, and it is contemplated that the present invention covers other embodiments of arrays, actuators, and actuation systems not specifically illustrated or described herein, having alternative geometries. For example, while the conductive coil 20 dimensioned as described above may produce a high level of heat, and therefore may be suitable for an aerodynamic application (e.g., high forced convection) or a duty cycle of 10% or less, it should be recognized that alternative coil sizes may be selected based on factors such as desired thrust (force) and heating.

Referring back to FIG. 1, copper sheet 28 may be attached to one of the magnetic arrays 12, separating the magnetic array 12 from the conductive coil 20. One of the functions of the copper sheet 28 may be to act as a heat sink, dissipating heat from the conductive coil 20. The copper sheet 28 may contain radial separations to avoid operating as a conductor for the current in the conductive coil 20 and thereby altering the dynamics of the magnetic fields.

Those skilled in the art will recognize that the inner magnet 18 of an array consistent with the present Invention may be either an annular or cannulated member (i.e., hollow), or alternatively, a solid cylindrical member (which would affect the configuration of the rod). A magnetic array 12 consistent with the invention having an inner magnet 18 that has an aperture, or hole, along its central axis may or may not be fixed to another component as is part of an actuation system.

The magnetic array and actuator 10 may be arranged such that a distance between the nested magnetic arrays 12 is equivalent to between about twice a radius of the outer magnets 14 of the nested magnetic arrays 12 and six times the radius of the outer magnets 14 of the nested magnetic arrays 12. More preferably, the magnetic array and actuator 10 may be arranged such that the distance between the nested magnetic arrays 12 is approximately four times the radius of the outer magnets 14 of the nested magnetic arrays 12.

Figure 9A:
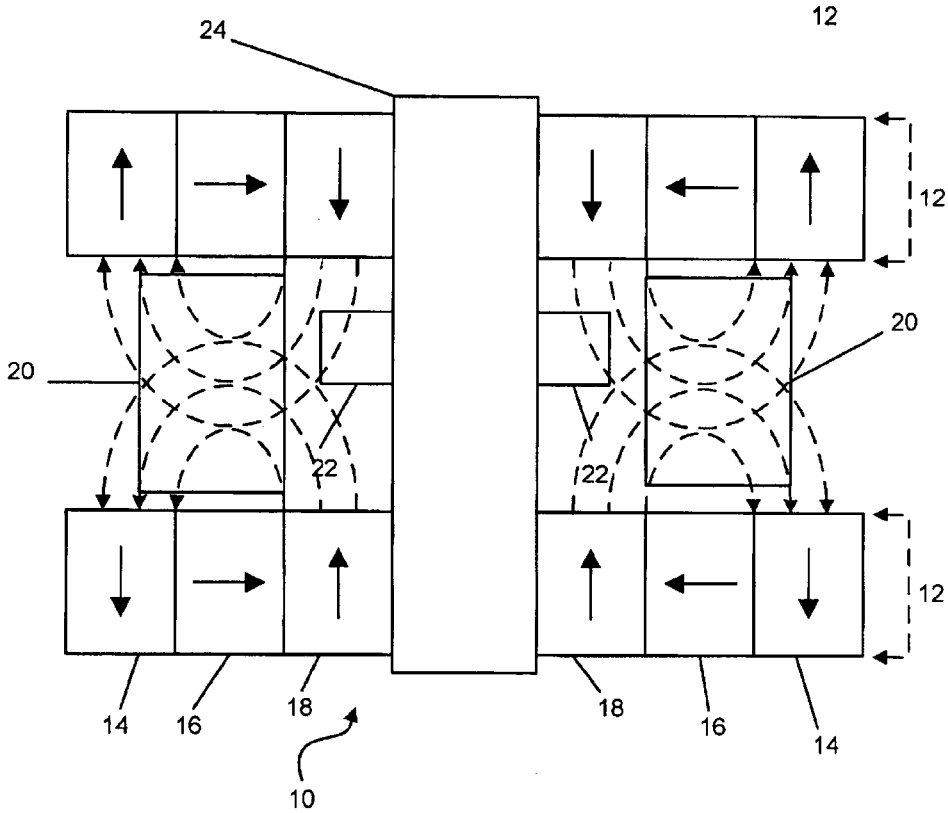
FIG. 9 is a cross-sectional view of the magnetic array and actuator of FIG. 1 illustrating the radial magnetic field orientation.

FIG. 9 shows the effect of the magnetization of each of the magnets 14, 16, 18 on the conductive coil 20 and the substantially magnetically permeable object 22. FIG. 9A shows the magnetic array and actuator 10 without current traveling through the conductive coil 20. As shown, one nested magnetic array 12 is on top of the conductive coil 20 and the substantially magnetically permeable object 22 and another nested magnetic array 12 is shown at the bottom. The top nested magnetic array 12 is magnetically inverted with respect to the nested magnetic array 12 on the bottom. That is, the top nested magnetic array 12 is positioned so that the direction of the magnetic field in the top inner magnet 18 is anti-parallel to the magnetic field in the bottom inner magnet 18 and the direction of the magnetic field in the top outer magnet 14 is antiparallel to the magnetic field in the bottom outer magnet 14. As a result, the axial forces of the top nested magnetic array 12 and the bottom nested magnetic array 12 substantially cancel each other out, while the radial force of the nested magnetic arrays 12 is combined and, thereby, magnified. Neither the conductive coil 20, nor the substantially magnetically permeable object 22 is affected as neither item can be moved radially.

Figure 9B:
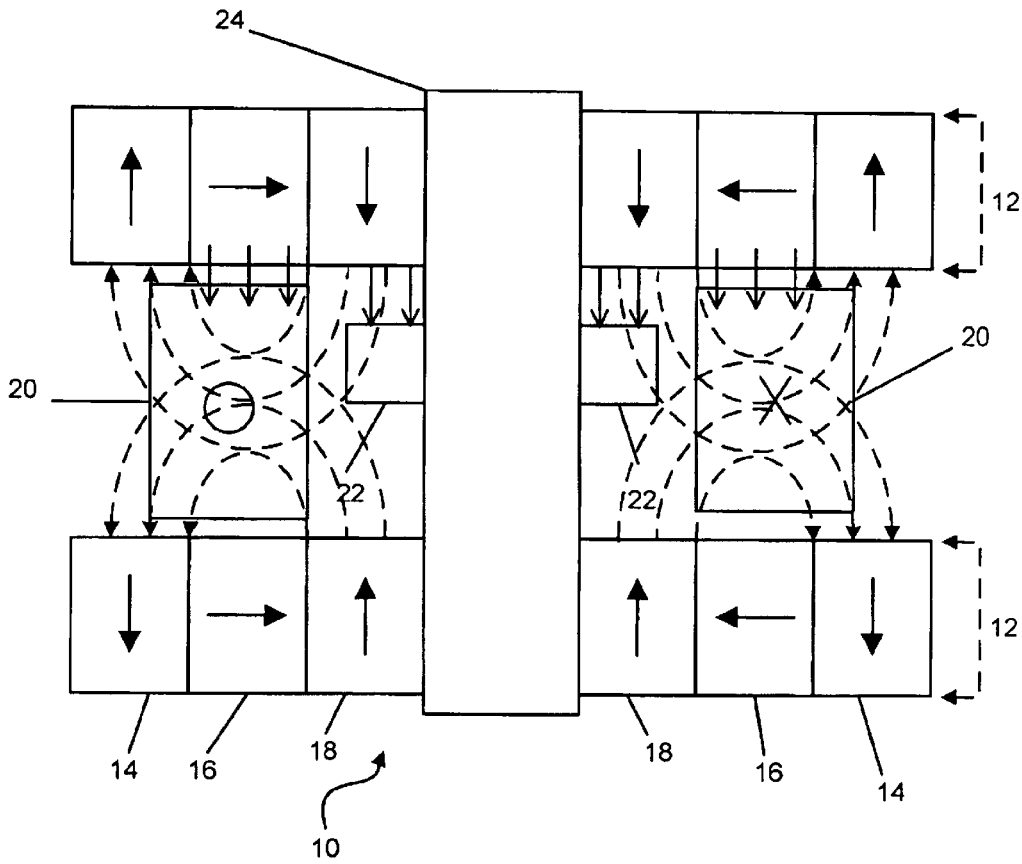

FIG. 9B shows the same arrangement as FIG. 9A with the addition of current being conducted through the conductive coil 20. As shown, the current is traveling out of the page at the section of conductive coil 20 marked with a circle and into the page at the section of conductive coil 20 marked with an "X". As a result of the current in the conductive coil 20, an additional magnetic force is provided, which results in a downward force, in this example, on both the conductive coil 20 and the substantially magnetically permeable object 22. As the conductive coil 20 is provided with substantially no space to move axially, the conductive coil 20 is substantially unmoved by the applied force. However, the substantially magnetically permeable object 22 is moved downward, as is the rod 24 to which the substantially magnetically permeable object 22 is integrally attached.

One of the fields of application envisioned for the present invention is the automotive field. The magnetic array and actuator 10 can be used to provide a fully electronically-controlled inlet exhaust valve actuating system. Simply providing current to the conductive coil 20 can actuate a valve connected to the rod 24. A fully electronically-controlled inlet/exhaust valve actuating system eliminates camshafts completely, thus (1) eliminating the packaging restrictions placed upon an engine by conventional camshaft profiling, and (2) allowing optimization of the gas exchange process across the whole engine speed and load range. Electromagnetic actuation of intake and exhaust valves in an engine affords greater control over the emissions, overall efficiency, and performance of the vehicle.

Figure 10:
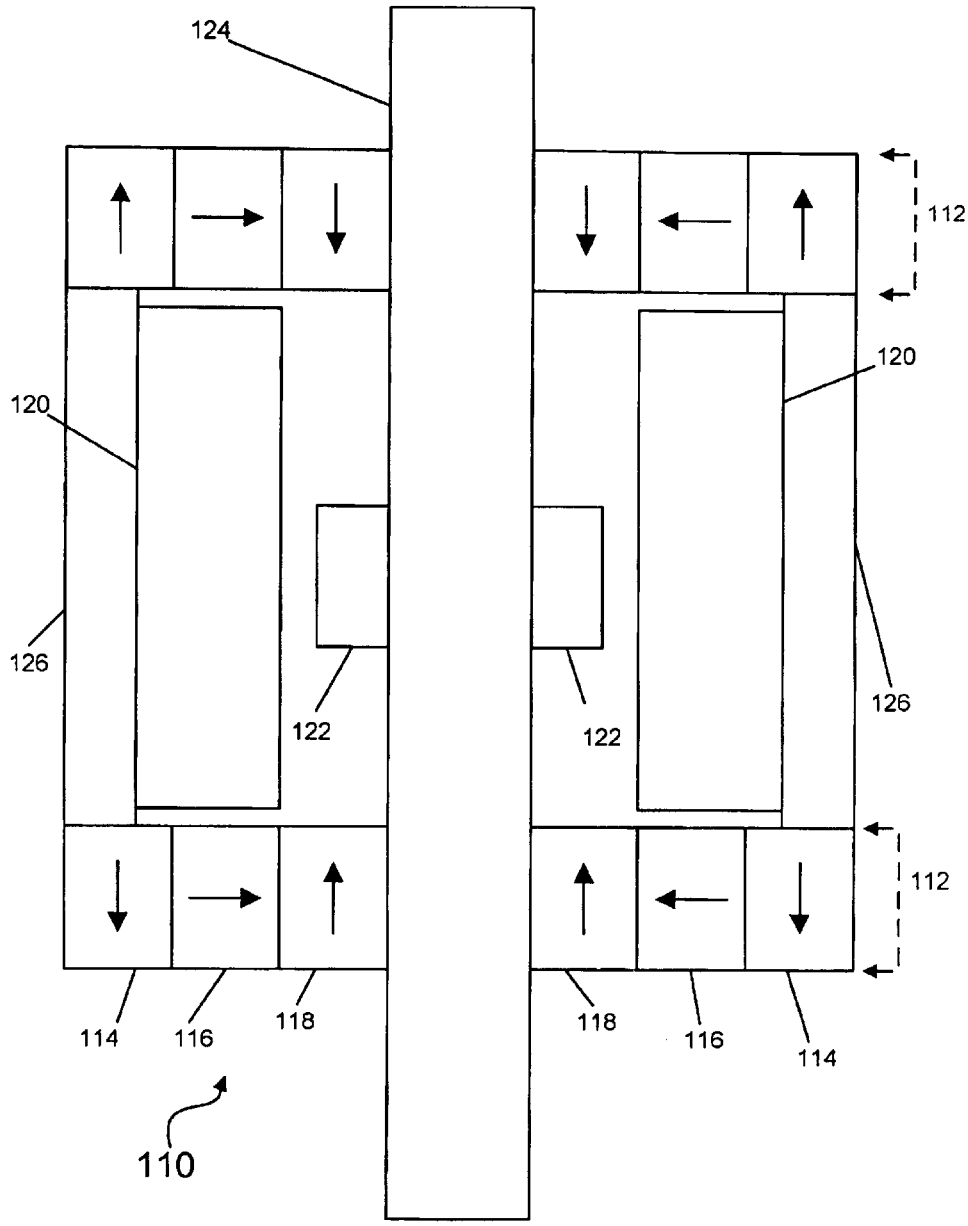
FIG. 10 is a cross-sectional view of a second exemplary embodiment of the magnetic array and actuator of the present invention.

FIG. 10 is a cross-sectional view of a second exemplary embodiment of the magnetic array and actuator 110. At least one set of two nested magnetic arrays 112 is provided, each nested magnetic array 112 having an outer magnet 114, a middle magnet 116, and an inner magnet 118. Arrows shown within the magnets 114, 116, 118, illustrate the magnetization of the three magnets 114, 116, 118. The outer magnet 114 has a magnetization pointing in an at least partially axial direction. The middle magnet 116 has a magnetization substantially perpendicular to the magnetization of the outer magnet 114. The inner magnet 118 has a magnetization directed substantially anti-parallel to the magnetization of the outer magnet 114. Comparing the magnetization of the magnets 114, 116, 118 in the two nested magnetic arrays 112, the magnetizations of the two outer magnets 114 are anti-parallel, the magnetizations of the two middle magnets 116 are parallel, and the magnetizations of the two inner magnets 118 are anti-parallel. The magnetic array and actuator 110 also includes at least one electrically conductive coil 120 positioned at least partially between the two nested magnetic arrays 112. At least one substantially magnetically permeable object 122 is positioned at least partially between the two nested magnetic arrays 112 and, in this second exemplary embodiment, at least partially, radially within at least one of the electrically conductive coils 120. A rod 124 is integral with the substantially magnetically permeable object 122 and extends axially within each of the two nested magnetic arrays 112 and the electrically conductive coil 120. Specifically, the magnetic arrays 112 provide an opening within which the rod 124 is located. Therefore, the rod 24 is capable of vertically shifting through the magnetic arrays 112.

A magnetically permeable back iron 126 is connected to and extending between each of the outer magnets 114 in the set of nested magnetic arrays 112. The magnetically permeable back iron 126 is used to focus the paths of the magnetic fields and may be used for this purpose with any of the embodiments of the invention described herein. In other embodiments the magnetically permeable back iron 126 may be more usefully located between other portions of the nested magnetic arrays 112.

A current may be distributed over the conductive coil 120, wherein a magnetic field of at least one of the nested magnetic arrays 112 may be substantially perpendicular to the current in the conductive coil 120. The rod 124 may be substantially magnetically impermeable. The magnetic array and actuator 110 will function if the rod 124 is magnetically permeable, however the rod 124 may then interfere with the magnetization and, as a result, cause the magnetic array and actuator 110 to operate less efficiently.

Figure 11:
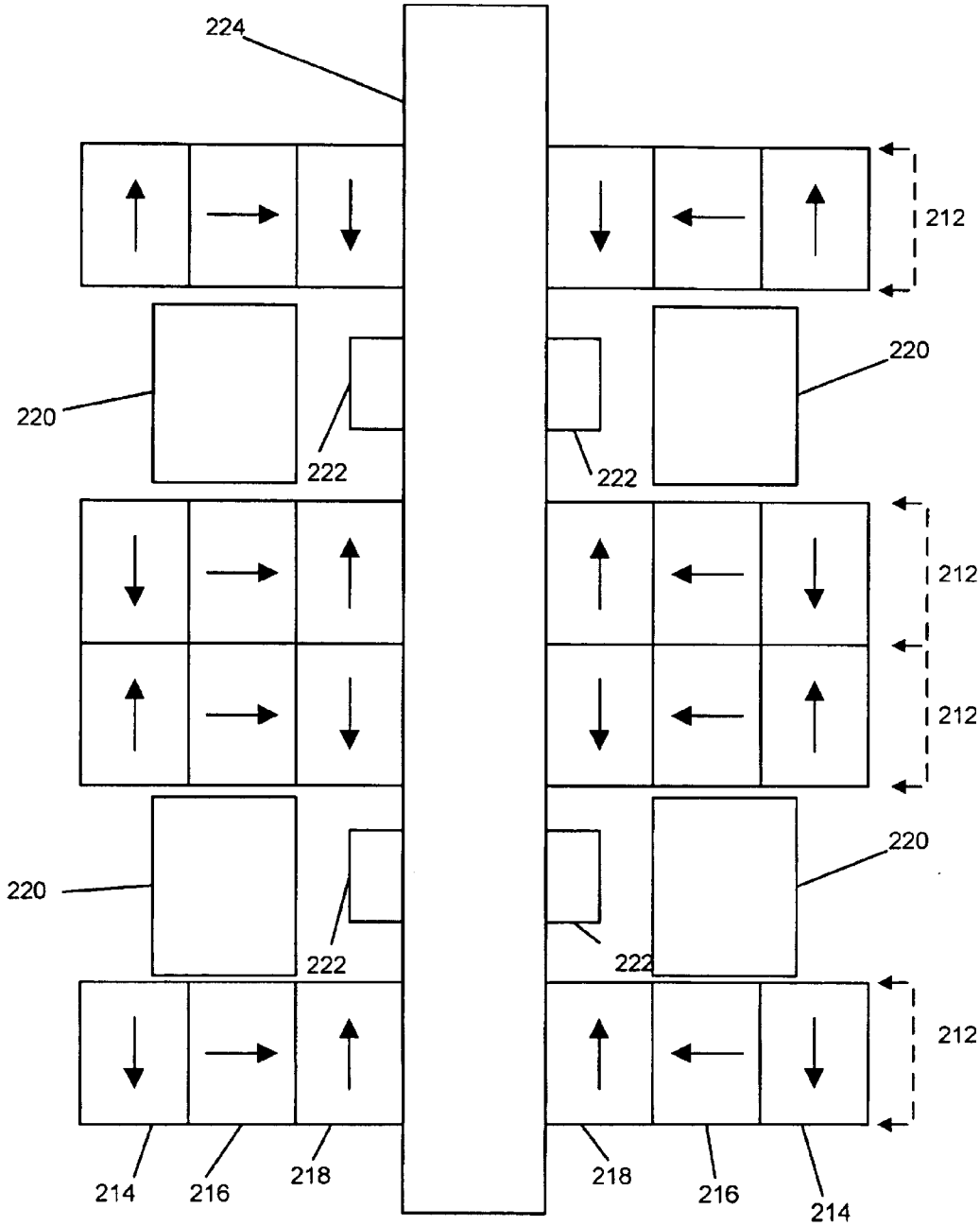
FIG. 11 is a cross-sectional view of a third exemplary embodiment of the magnetic array and actuator of the present invention.

FIG. 11 is a cross-sectional view of a third exemplary embodiment of the magnetic array and actuator 210. The magnetic array and actuator 210 includes two sets of two nested magnetic arrays 212. Each nested magnetic array 212 having an outer magnet 214, a middle magnet 216, and an inner magnet 218. Arrows shown within the magnets 214, 216, 218 illustrate the magnetization of the three magnets 214, 216, 218. The outer magnet 214 has a magnetization pointing in an at least partially axial direction. The middle magnet 216 has a magnetization substantially perpendicular to the magnetization of the outer magnet 214. The inner magnet 218 has a magnetization directed substantially anti-parallel to the magnetization of the outer magnet 214. Comparing the magnetization of the magnets 214, 216, 218 in the two nested magnetic arrays 212 of each set, the magnetizations of the two outer magnets 214 are anti-parallel, the magnetizations of the two middle magnets 216 are parallel, and the magnetizations of the two inner magnets 218 are anti-parallel. The two sets of two magnetic arrays 212 are axially aligned and abut each other. Comparing the magnetization of the magnets 214, 216, 218 in the abutting nested magnetic arrays 212 of each set, the magnetizations of the two outer magnets 214 are anti-parallel, the magnetizations of the two middle magnets 216 are parallel, and the magnetizations of the two inner magnets 218 are anti-parallel. The magnetic array and actuator 210 also includes two electrically conductive coils 220. One electrically conductive coil 220 is positioned at least partially within each of the two sets of nested magnetic arrays 212. One substantially magnetically permeable object 222 is positioned at least partially between each of the two sets of two nested magnetic arrays 212. A rod 224 is integral with the substantially magnetically permeable object 222 and extends axially within each of the sets of two nested magnetic arrays 212 and the electrically conductive coils 220. Specifically, the magnetic arrays 212 provide an opening within which the rod 224 is located. Therefore, the rod 224 is capable of vertically shifting through the magnetic arrays 212.

Abutting two sets of nested magnetic arrays 212, as shown in FIG. 11, may be useful for increasing the force applied to the rod 224, if both substantially magnetically permeable objects 222 are attached to one rod 224, without increasing the intensity of the individual nested magnetic arrays 212. Alternatively, the arrangement of abutting nested magnetic arrays 212 may be used to affect two different rods 224 in the same area, although affecting two rods 224 would necessitate locating at least one of the substantially magnetically permeable objects 222 along a periphery of the space between the set of two nested magnetic arrays 212, an arrangement which is discussed further herein. The individual abutting nested magnetic arrays 212 shown in FIG. 11 have anti-parallel magnetic forces applied at the inner magnet 218 and the outer magnet 214, substantially canceling the magnetic force from those magnets 214, 218 and leaving only the combined radial magnetic force from the middle magnet 216. Alternatively, a single magnet having only a radial magnetic force can be used to replace the individual abutting nested magnetic arrays 212.

Figure 12:
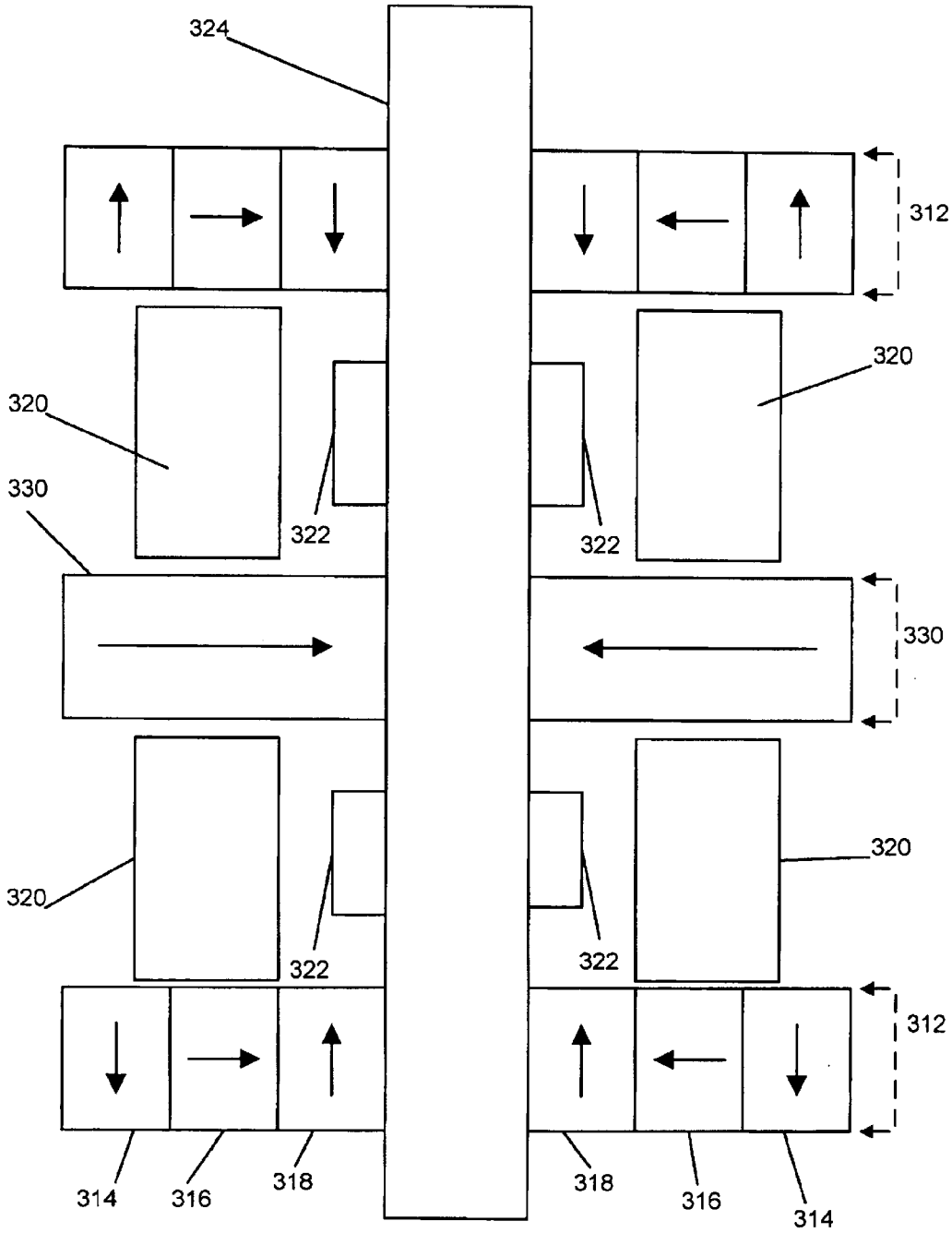
FIG. 12 is a cross-sectional view of a fourth exemplary embodiment of the magnetic array and actuator of the present invention.

FIG. 12 is a cross-sectional view of a fourth exemplary embodiment of the magnetic array and actuator 310. One set of two nested magnetic arrays 312 is provided, each nested magnetic array 312 having an outer magnet 314, a middle magnet 316, and an inner magnet 318. Arrows shown within the magnets 314, 316, 318, illustrate the magnetization of the three magnets 314, 316, 318. The outer magnet 314 has a magnetization pointing in an at least partially axial direction. The middle magnet 316 has a magnetization substantially perpendicular to the magnetization of the outer magnet 314. The inner magnet 318 has a magnetization directed substantially anti-parallel to the magnetization of the outer magnet 314. Comparing the magnetization of the magnets 314, 316, 318 in the two nested magnetic arrays 312, the magnetizations of the two outer magnets 314 are anti-parallel, the magnetizations of the two middle magnets 316 are parallel, and the magnetizations of the two inner magnets 318 are anti-parallel. A third magnetic array 330 is mounted between the two nested magnetic arrays 312. The third magnetic array 330 has a singular magnetization that is substantially parallel to the magnetization of the middle magnets 316. The magnetic array and actuator 310 also includes two electrically conductive coils 320, one electrically conductive coil 320 positioned at least partially between the third magnetic array 330 and each of the two nested magnetic arrays 312. Two substantially magnetically permeable objects 322 are provided, one of the substantially magnetically permeable objects 322 is positioned at least partially between the third magnetic array 330 and each of the two nested magnetic arrays 312. A rod 324 is integral with the substantially magnetically permeable object 322 and extends axially within each of the two nested magnetic arrays 312, the third magnetic array 330 and the electrically conductive coil 320. Specifically, the magnetic arrays 312 provide an opening within which the rod 324 is located. Therefore, the rod 324 is capable of vertically shifting through the magnetic arrays 312.

FIG. 11 and FIG. 12 are essentially equivalent. The third magnet 330 in FIG. 12 has the same effect in magnetic array and actuator 310 that the two abutting nested magnetic arrays 212 have at the center of the magnetic array and actuator 210 of FIG. 11. The sum forces resulting from the two abutting nested magnetic arrays 212 at the center of the magnetic array and actuator 210 of FIG. 11 are equivalent to the force resulting from the third magnet 330 of the magnetic array and actuator 310 of FIG. 12.

Figure 13:
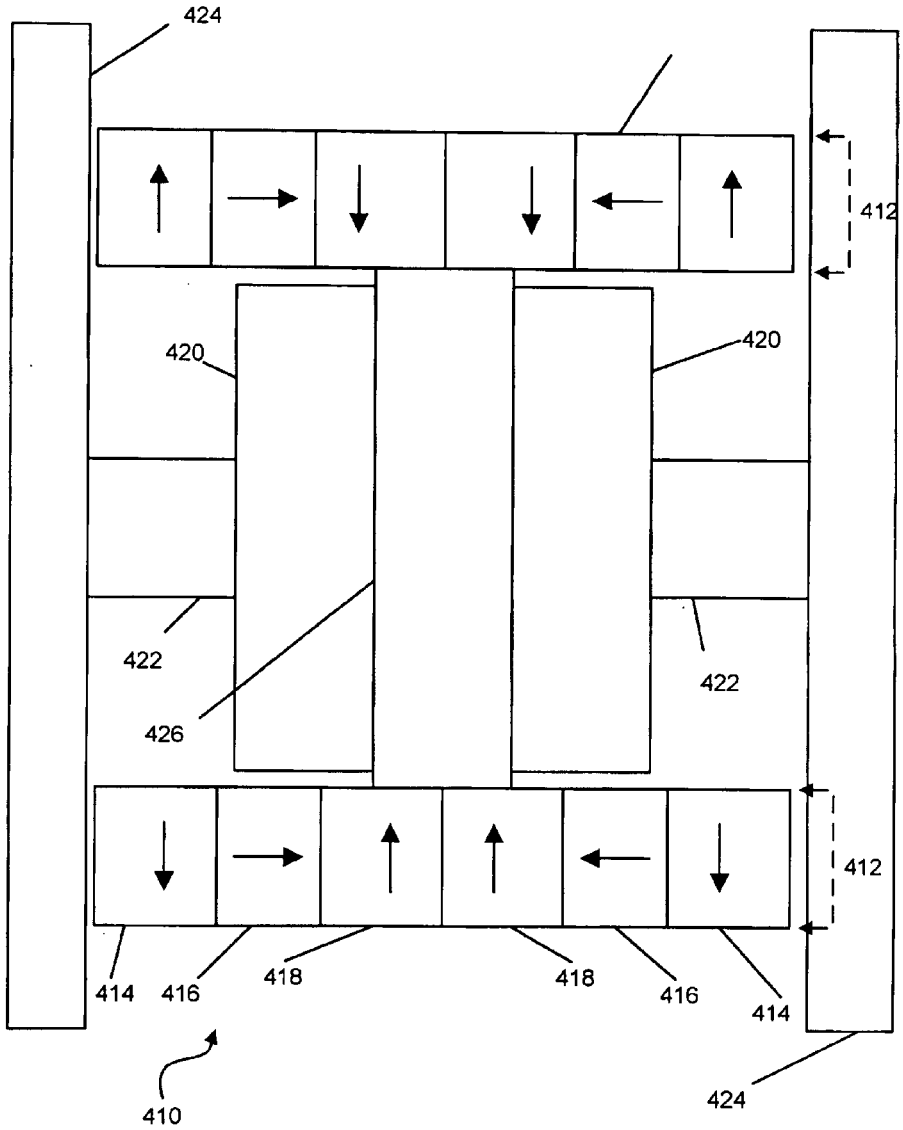
FIG. 13 is a cross-sectional view of a fifth exemplary embodiment of the magnetic array and actuator of the present invention.

FIG. 13 is a cross-sectional view of a fifth exemplary embodiment of the magnetic array and actuator 410. At least one set of two nested magnetic arrays 412 is provided, each nested magnetic array 412 having an outer magnet 414, a middle magnet 416, and an inner magnet 418. Arrows shown within the magnets 414, 416, 418 illustrate the magnetization of the three magnets 414, 416, 418. The outer magnet 414 has a magnetization pointing in an at least partially axial direction. The middle magnet 416 has a magnetization substantially perpendicular to the magnetization of the outer magnet 414. The inner magnet 418 has a magnetization directed substantially anti-parallel to the magnetization of the outer magnet 414. Comparing the magnetization of the magnets 414, 416, 418 in the two nested magnetic arrays 412, the magnetizations of the two outer magnets 414 are anti-parallel, the magnetizations of the two middle magnets 416 are parallel, and the magnetizations of the two inner magnets 418 are anti-parallel. The magnetic array and actuator 410 also includes at least one electrically conductive coil 420 positioned at least partially between the two nested magnetic arrays 412. At least one substantially magnetically permeable object 422 is positioned at least partially between the two nested magnetic arrays 412 and radially exterior to the electrically conductive coil 420. A rod 424 is integral with the substantially magnetically permeable object 422 and extends axially along the two nested magnetic arrays 412. A magnetically permeable back iron 426 is positioned between the inner magnets 418 of the nested magnetic arrays 412.

The fifth exemplary embodiment of the magnetic array and actuator 410, as shown in FIG. 13, permits the rod 424 to be placed exterior to the nested magnetic arrays 412 rather than piercing the nested magnetic arrays 412. Those having ordinary skill in the art will recognize that this embodiment may be combined with various other embodiments for different effects. Two abutting sets of nested magnetic arrays 412 may be provided, one set having the rod 424 exterior to the nested magnetic arrays 412 and one set having the rod 424 piercing the nested magnetic arrays 412. The rod 424 may be a hollow cylinder encapsulating the nested magnetic arrays 412 or the rod 424 may simply be attached on only one side of the nested magnetic arrays 412.

Figure 14:
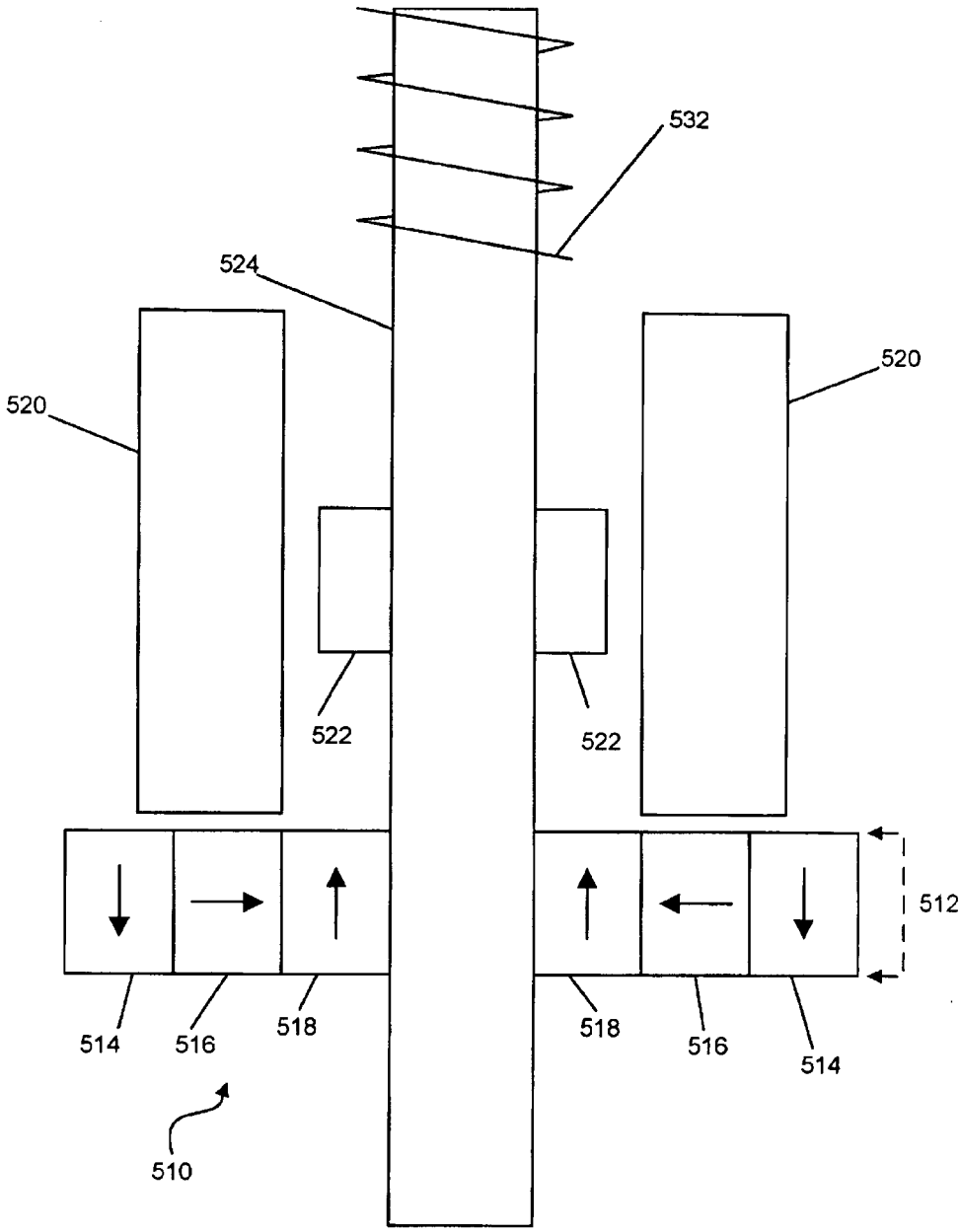
FIG. 14 is a cross-sectional view of a sixth exemplary embodiment of the magnetic array and actuator of the present invention.

FIG. 14 is a cross-sectional view of a sixth exemplary embodiment of the magnetic array and actuator 510. The magnetic array and actuator 510 includes a composite magnet 512 with a magnetic force, the magnetic force having at least a vertical component and a radial component. An electrically conductive coil 520 is axially aligned with and positioned proximate to the composite magnet 512 for enhancing and/or altering the magnetic force. A substantially magnetically permeable object 522 having a range of movement is positioned sufficiently proximate to the composite magnet 512 to be moved by the magnetic force as enhanced or altered by the electrically conductive coil 520. A counterbalance 532 is positioned proximate to the substantially magnetically permeable object 522 to limit the range of movement of the substantially magnetically permeable object 522 whereby the substantially magnetically permeable object 522 remains proximate to the composite magnet 512.

The counterbalance 532 may be a spring, a magnet, an elastic object, a rigid object, gravity, or any other element or force capable of restraining the substantially magnetically permeable object 522, particularly while the magnetic force, or lack thereof, is urging the substantially magnetically permeable object 522 away from the composite magnet 512. The counterbalance 523 keeps the substantially magnetically permeable object 522 proximate to the composite magnet 512. The composite magnet 512 in the sixth exemplary embodiment may be formed identically to the described nested magnetic array 12 of the first exemplary embodiment or it may be designed otherwise.

Figure 15:
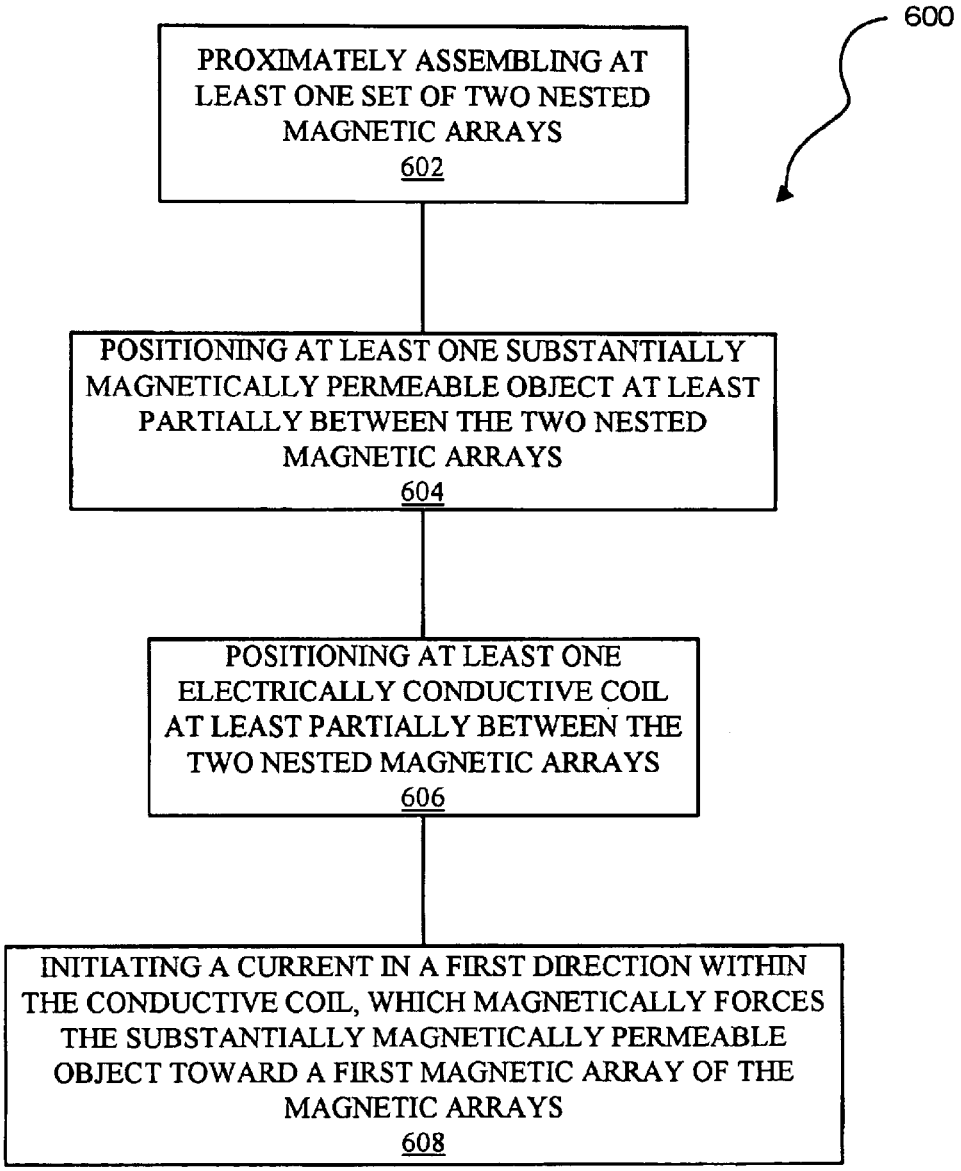
FIG. 15 is a flow chart of one method of using the magnetic arrays and actuator of FIG. 1, in accordance with the first exemplary embodiment.

The flow chart of FIG. 15 shows the functionality and operation of a possible implementation of the magnetic array and actuator. In this regard, each block represents a module, segment, or step, which comprises one or more instructions for implementing the specified function. It should also be noted that in some alternative implementations, the functions noted in the blocks might occur out of the order noted in FIG. 15. For example, two blocks shown in succession in FIG. 15 may in fact be executed substantially concurrently or the blocks may sometimes be executed in the reverse order, depending upon the functionality involved, as will be further clarified herein.

As shown in FIG. 15, a method 600 for moving an actuator includes proximately assembling at least two nested magnetic arrays 12 (block 602). Each nested magnetic array 12 includes an outer magnet 14 having a magnetization pointing in an at least partially axial direction. Each nested magnetic array 12 includes a middle magnet 16 having a magnetization substantially perpendicular to the magnetization of the outer magnet 14. Each nested magnetic array 12 also includes an inner magnet 18 having a magnetization directed substantially anti-parallel to the magnetization of the outer magnet 14. The method 600 also includes positioning at least one substantially magnetically permeable object 22 at least partially between the two nested magnetic arrays 12 (block 604). The method 600 also includes positioning at least one electrically conductive coil 20 at least partially between the two nested magnetic arrays 12 (block 606). The method 600 also includes initiating a current in a first direction within the conductive coil 20, which magnetically forces the substantially magnetically permeable object 22 toward a first magnetic array 12 of the magnetic arrays 12 (block 608).

It should be emphasized that the above-described embodiments of the present invention, are merely possible examples of implementations, merely set forth for a clear understanding of the principles of the invention. Many variations and modifications may be made to the above-described embodiment of the invention without departing substantially from the spirit and principles of the invention. All such modifications and variations are intended to be included herein within the scope of this disclosure and the present invention and protected by the following claims.

What is claimed is:

1. An apparatus, comprising:

at least two nested magnetic arrays;

at least one of the two nested magnetic arrays comprising:

an outer magnet having a magnetization pointing in an at least partially axial direction;

a middle magnet having a magnetization substantially perpendicular to the magnetization of the outer magnet; and an inner magnet having a magnetization directed substantially anti-parallel to the magnetization of the outer magnet;

at least one electrically conductive coil positioned at least partially between the two nested magnetic arrays;

at least one substantially magnetically permeable object positioned at least partially between the two nested magnetic arrays; and an actuating rod integral with the substantially magnetically permeable object and extending therefrom.

2. The apparatus of claim 1 further comprising a back iron connected to and extending between each of the outer magnets in the set of nested magnetic arrays.

3. The apparatus of claim 1 further comprising a current distributed over the conductive coil, wherein a magnetic field of at least one of the nested magnetic arrays is substantially perpendicular to the current in the coil.

4. The apparatus of claim 1 wherein the rod is substantially magnetically impermeable.

5. The apparatus of claim 1 wherein the distance between the nested magnetic arrays is equivalent to between about twice the radius of the outer magnets of the nested magnetic arrays and six times the radius of the outer magnets of the nested magnetic arrays.

6. The apparatus of claim 1 wherein the distance between the nested magnetic arrays is approximately four times the radius of the outer magnets of the nested magnetic arrays.

7. The apparatus of claim 1 further comprising at least one copper sheet attached to one of the magnetic arrays between the magnetic array and one of the conductive coils.

8. The apparatus of claim 1 comprising:

two sets of two nested magnetic arrays wherein each individual set of magnetic arrays comprises:

one electrically conductive coil positioned at least partially within the individual set of nested magnetic arrays; and one substantially magnetically permeable object positioned at least partially between the individual set of nested magnetic arrays and at least partially, radially within the one electrically conductive coil; and wherein the rod is integral with each of the substantially magnetically permeable objects and extends axially within each of the sets of two nested magnetic arrays and each of the electrically conductive coils.

9. The apparatus of claim 1 further comprising:

a third magnetic array having a magnet having a magnetization substantially parallel to the magnetization of the middle magnet, the third magnetic array positioned axially between the two nested magnetic arrays in the set of two nested magnetic arrays;

wherein the at least one electrically conductive coil further comprises two electrically conductive coils, one electrically conductive coil positioned at least partially between each of the nested magnetic arrays and the third magnetic array;

wherein the at least at least one substantially magnetically permeable object further comprises two substantially magnetically permeable object, one substantially magnetically permeable object positioned at least partially between each of the nested magnetic arrays and the third magnetic array.

10. The apparatus of claim 1 wherein the rod extends axially within each of the at least two nested magnetic arrays and each of the at least one electrically conductive coils.

11. A method for actuating, said method comprising the steps of:

proximately assembling at least one set of two nested magnetic arrays, the magnetic arrays comprising:

an outer magnet having a magnetization pointing in an at least partially axial direction;

a middle magnet having a magnetization substantially perpendicular to the magnetization of the outer magnet; and an inner magnet having a magnetization directed substantially anti-parallel to the magnetization of the outer magnet;

positioning at least one substantially magnetically permeable object at least partially between the two nested magnetic arrays;

positioning at least one electrically conductive coil at least partially between the two nested magnetic arrays; and initiating a current in a first direction within the conductive coil, which magnetically forces the substantially magnetically permeable object toward a first magnetic array of the magnetic arrays.

12. The method of claim 11 further comprising redirecting the current in a direction opposite the first direction, forcing the substantially magnetically permeable object toward a second magnetic array of the magnetic arrays.

13. The method of claim 11 further comprising dissipating heat proximate to the conductive coil with a copper sheet attached to one of the magnetic arrays.

14. The method of claim 11 wherein the step of assembling at least one set of two nested magnetic arrays further comprises mounting the set of two arrays a fixed distance apart wherein the fixed distance is approximately equivalent to four times the radius of one of the magnetic arrays.

15. The method of claim 11 further comprising focusing the magnetization of the nested magnetic arrays by inserting a back iron connecting the outer magnets of the nested magnetic arrays.

16. A system for magnetically moving an actuator, the system comprising:

means for providing a first magnetic force, the first magnetic force having at least a first vertical direction and a first radial direction;

means for providing a second magnetic force proximate to the means for providing a first magnetic force, the second magnetic force having a second vertical direction opposing the first vertical direction and a second radial direction cooperative with the first radial direction;

means for actuating approximately statically balanced by the first magnetic force and the second magnetic force; and means for electrically adding a third magnetic force that, once added, unbalances the means for actuating and causes the means for actuating to move.

17. An actuator, comprising:

a first composite magnet with a first magnetic force, the first magnetic force having at least a first axial direction and a first radial direction;

a second composite magnet with a second magnetic force, the second composite magnet proximate to the first composite magnet and the second magnetic force having a second axial direction and a second radial direction wherein the first axial direction and the second axial direction are symmetrically opposed and the first radial direction and the second radial direction are cooperative;

an electrically conductive coil positioned at least partially between the first and second composite magnets; and a substantially magnetically permeable object positioned between the first and second composite magnet.

18. The actuator of claim 17 further comprising an actuating rod attached to the substantially magnetically permeable object wherein the actuating rod is substantially magnetically impermeable.

19. An actuator, comprising:

a composite magnet with a magnetic force, the magnetic force having at least a vertical direction and a radial direction;

an electrically conductive coil axially aligned with and positioned proximate to the composite magnet;

a substantially magnetically permeable object having a range of movement positioned sufficiently proximate to the composite magnet to be moveable through the magnetic force; and a counterbalance positioned to limit the range of movement of the substantially magnetically permeable object whereby the substantially magnetically permeable object remains proximate to the composite magnet.

20. The actuator of claim 19 wherein the counterbalance is a second composite magnet.

21. The actuator of claim 19 further comprising a rod integral with the substantially magnetically permeable object and wherein the counterbalance is a spring.

22. An actuator, comprising:

a first composite magnet with a first magnetic force, the first magnetic force having a first radial direction;

a second composite magnet with a second magnetic force, the second composite magnet proximate to the first composite magnet and the second magnetic force having a second radial direction wherein the first radial direction and the second radial direction are parallel;

an electrically conductive coil positioned at least partially between the first and second composite magnets; and a substantially magnetically permeable object positioned between the first and second composite magnet.

* * * * *